US008304658B2

(12) United States Patent
Barthelmes et al.

(10) Patent No.: US 8,304,658 B2
(45) Date of Patent: Nov. 6, 2012

(54) NI-P LAYER SYSTEM AND PROCESS FOR ITS PREPARATION

(75) Inventors: Juergen Barthelmes, Berlin (DE); Robert Ruether, Oranienburg (DE); Olaf Kurtz, Berlin (DE); Michael Danker, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 295 days.

(21) Appl. No.: 12/919,664

(22) PCT Filed: Mar. 5, 2009

(86) PCT No.: PCT/EP2009/001573

§ 371 (c)(1),
(2), (4) Date: Aug. 26, 2010

(87) PCT Pub. No.: WO2009/115192

PCT Pub. Date: Sep. 24, 2009

(65) Prior Publication Data

US 2010/0326713 A1 Dec. 30, 2010

(30) Foreign Application Priority Data

Mar. 20, 2008 (EP) ..... 08005350

(51) Int. Cl.
*H05K 1/09* (2006.01)

(52) U.S. Cl. ..... 174/257

(58) Field of Classification Search ..... 174/257
See application file for complete search history.

(56) References Cited

U.S. PATENT DOCUMENTS

| | | | | |
|---|---|---|---|---|
| 6,457,234 | B1 * | 10/2002 | Edelstein et al. | 29/843 |
| 6,779,711 | B2 * | 8/2004 | Edelstein et al. | 228/180.1 |
| 8,012,000 | B2 * | 9/2011 | Wang et al. | 451/533 |
| 2002/0020629 | A1 | 2/2002 | Park et al. | |
| 2005/0048309 | A1 | 3/2005 | Haketa | |
| 2005/0178666 | A1 * | 8/2005 | Tsai et al. | 205/118 |
| 2007/0052105 | A1 | 3/2007 | Lau et al. | |
| 2010/0028572 | A1 * | 2/2010 | Kobayashi et al. | 428/34.1 |

FOREIGN PATENT DOCUMENTS

| | | | |
|---|---|---|---|
| EP | 0 410 472 | A2 | 1/1991 |
| EP | 2 014 798 | A1 | 1/2009 |

OTHER PUBLICATIONS

V.W. Goetz et al., "Steckverbinder: Hohe Zuverlassigkeit bei reduziertem Edelmetalleinsatz", Galvanotechnik 9, pp. 2130-2140 (2003).

Schlesinger et al., "Paunovic: Modern Electroplating", 4th Edition, John Wiley & Sons, Inc.—New York, p. 147 (2000).

* cited by examiner

*Primary Examiner* — Gregory Thompson

(74) *Attorney, Agent, or Firm* — Peter F. Corless; Christine C. O'Day; Edwards Wildman Palmer LLP

(57) ABSTRACT

The invention relates to a layer system comprising on a substrate, the surface of which has been electropolished, (i) a Ni layer having a thickness ≦3.0 μm, (ii) a Ni—P layer having a thickness ≦1.0 μm, and (iii) a Au layer having a thickness ≦1.0 μm.

15 Claims, 1 Drawing Sheet

Results from Nitric-Acid Vapour corrosion resistant tests according to ASTM B735-95.

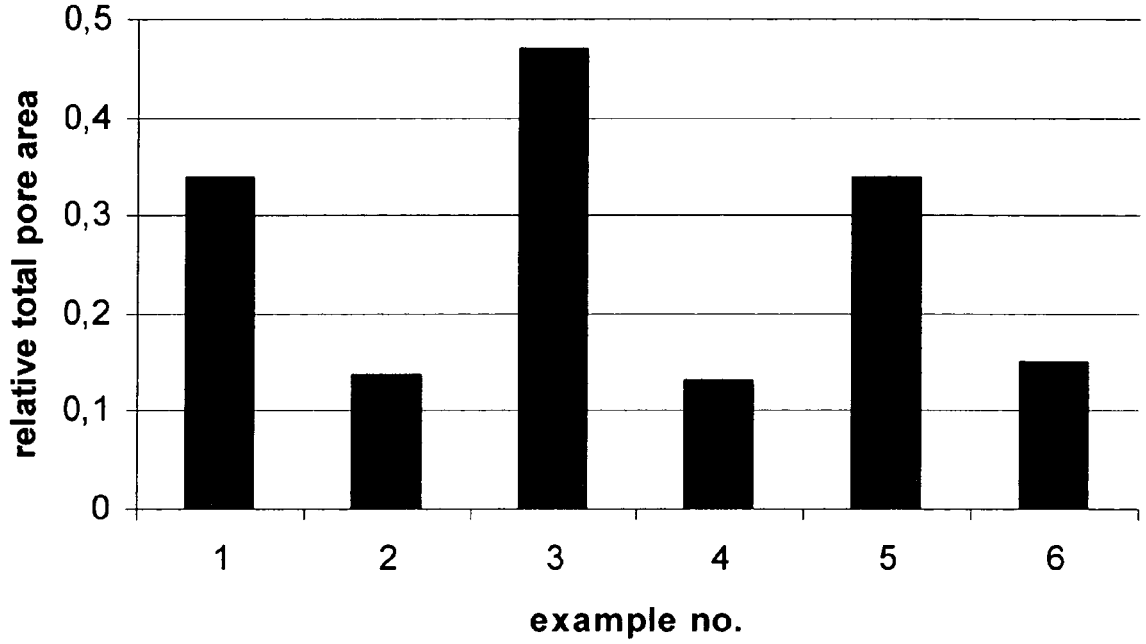
Results from Nitric Acid Vapour corrosion resistant tests according to ASTM B735-95.

NI-P LAYER SYSTEM AND PROCESS FOR ITS PREPARATION

FIELD OF THE DISCLOSURE

The invention relates to a corrosion-resistant electrically conductive layer system comprising a Ni—P layer and an Au layer on a substrate, preferably a copper-based substrate. The invention further relates to a process for the preparation of such a system and an electronic device substrate comprising it.

BACKGROUND OF THE INVENTION

The corrosion requirements in technical applications, especially in the connector industry, are becoming more and more demanding. One example is the requested corrosion resistance where the efforts to standardise the technical requirements are partly not able to follow the market demands.

Gold plating is often used in electronics, to provide a corrosion-resistant electrically conductive layer on copper, typically in electrical connectors and printed circuit boards. Without using a barrier metal, the copper atoms tend to diffuse through the gold layer, causing tarnishing of its surface and formation of an oxide and/or sulfide layer. A layer of a suitable barrier metal like nickel is deposited on the copper substrate before the gold plating. The layer of nickel provides mechanical backing for the gold layer, improving its wear resistance. It also reduces the impact of pores present in the gold layer. Both the nickel and gold layers are usually deposited by electroplating or electroless plating.

To increase the corrosion, wear and heat resistance a layer comprising nickel and phosphorus can be used instead of pure nickel. With increasing phosphorus content the layer becomes less ductile and brittle which causes cracking and weakening of the parts. Furthermore the lower plating speed compared to nickel is another disadvantage because the velocity of the continuous plating line has to be reduced and the number of plating cells must be increased respectively.

In Götz, Heinisch and Leyendecker is described the optimisation of Ni/Ni—P/Au—Co layer combination to produce reliable connectors with reduced precious metals (W. Götz, T. Heinisch, K. Leyendecker, Galvanotechnik 9 (2003), 2130-2140). Herein the nickel-phosphorous layer is partly replaced by nickel, nickel-sulphamate in particular which has a higher plating rate and better ductility characteristics. For the qualification of the different layer combinations the IEC 61076-4-100/101/104 and the GR-1217-CORE standards have been used. Special connectors for telecommunication application have been used as test parts. As reference Ni/NiPd/AuCo plated connectors have been tested simultaneously. The Ni/NiP/Au plated connectors passed 10 days exposure to the 4-component mixed gas—according to IEC standard—and twice 125 insertion/withdrawal cycles. After 10 days storage for 21 days in damp heat (40° C., 93% RH) more than half of the test devices with Ni/NiP/Au failed whereas the Ni/NiPd/Au all passed.

The optimum layer thickness has been proven as Ni (1.5 μm), NiP (0.7 μm), Au (0.15 μm). The test criterion was the contact resistance.

The article gives no information about bending characteristics. The Ni—P layer thickness is with 0.5-1.0 μm still high. In addition there is no comment on the geometry of the connectors and consequently no hint whether these results are valid for different types of connectors with different geometries. The test criterion of the contact resistance gives reduced information for the contact area only but not for the adjacent areas.

SUMMARY OF THE DISCLOSURE

It is the object underlying the invention to provide a layer system having highest corrosion and wear resistant solderable metal coatings which is substantially resistant to tarnishing under heat treatment and which shows superior mechanical properties like fatigue resistance, ductility and tensile strength.

This object is achieved by a layer system comprising on a substrate, the surface of which has been electropolished, (i) a Ni layer having a thickness of ≦3.0 μm, (ii) a Ni—P layer having a thickness ≦1.0 μm, (iii) a Au layer having a thickness ≦1.0 μm.

BRIEF DESCRIPTION OF THE DRAWINGS

FIG. 1 shows the results from the nitric acid vapour corrosion test according to ASTM B 735-95 standard in terms of total pore area. The total pore area is defined as the ratio of pore area and total surface area of the specimens. The example numbers are in accordance with tables 1*a-c*.

DETAILED DESCRIPTION OF THE INVENTION

The layer system according to the present invention preferably comprises a copper-based substrate.

As used throughout this specification, the term "copper-based" refers to pure copper and to mixtures which contain copper, wherein the copper content is at least 50% by weight. The term "pure copper" refers to copper which is to at least 98% by weight copper. The mixture containing copper may be any mixture of copper with any other chemical element or with a plurality of chemical elements, like metals or semi-metals, and will be an alloy. For application of the invention, copper-based materials are most preferably pure copper materials.

The layer system according to the present invention comprises a nickel layer having a thickness of 0.1 to 3.0 μm, which layer is plated on the substrate surface before the Ni—P layer is deposited thereon. Preferably the nickel layer has a thickness of 1.0 to 2.0 μm, more preferably a thickness of 1.1 to 1.4 μm.

As mentioned above, the Ni—P layer has a thickness ≦1.0 μm. Preferably the Ni—P layer has a thickness in the range of 0.05 μm to 0.8 μm, more preferably 0.1 μm to 0.4 μm. The absolute lower limit for said Ni—P layer is 0.05 μm.

The Ni—P layer preferably has a phosphorous content of 3 to 25 wt.-%. More preferably, the phosphorous content is in the range of 4 to 17 wt.-% and most preferably 8 to 16 wt.-%.

The Au layer may comprise an additional element selected from the group consisting of Fe, Co, Ni or pure Au. The benefits of small amounts of Fe, Co, Ni in Au layers for electronic applications are described in ASTM B488-95. Such dopants act as brightener and enhance the abrasive properties of Au coatings. Furthermore, ASTM B488-95 describes the applicability of pure Au coatings as an alternative to Fe or Co or Ni doped Au coatings.

The Au layer has a thickness ≦1.0 μm. Preferably the Au layer has a thickness in the range of 0.05 μm to 0.7 μm, more preferably 0.1 μm to 0.4 μm. The absolute lower limit for said Au layer is 0.01 μm.

The layer system according to the present invention can be prepared by a process comprising the steps of electropolishing the surface of the substrate to be coated, plating a Ni layer ≦3.0 μm onto the electropolished surface, plating a Ni—P layer ≦1.0 μm onto the Ni layer and plating a thin Au layer having a thickness ≦1.0 μm onto the Ni—P layer.

Prior to the electropolishing step, the surface of the substrate is preferably treated by hot degreasing, cathodic degreasing and acid rinsing.

The step of plating an Au layer on the Ni—P layer may be followed by a post dip treatment of the layer system which will be described later. The post dip improves storage behaviour and solderability of the surface of the layer system in hot and humid environments.

The present invention is inter alia based on the surprising finding that the electrochemical polishing step prior to the step of plating a Ni/Ni—P layer onto the substrate surface is essential to minimise the geometry influence with respect to the current density distribution on the parts to be plated by smoothing and polishing of the metal surfaces while removing a microscopic amount of material from the metal surface.

Thus a minimum Ni—P layer of 0.05 μm is sufficient to improve the final corrosion resistance significantly. The advantage of this are better mechanical properties and also minimum adaption of 2 to 4 velocity to the lower speed Ni—P plating step which means less costs (the deposition speed from a Ni-sulfamate plating bath is 2-4 times faster than from a Ni—P plating bath). The P-content can be adjusted to different corrosion requirements through variations in the phosphorus coating species in the electrolytic bath and current densities during deposition.

Electrochemical polishing is known for anodic polishing of copper and copper alloys and is suitable for the application in strip to strip as well as reel to reel. It has smut removal capability and generates a fine and dense foam during operation.

The electropolishing process smoothes and streamlines the microscopic surface of a metal object. Consequently the surface becomes microscopically featureless. The metal is herein removed ion by ion from the surface being polished. Smoothness of the metal surface is one of the primary and most advantageous effects of electropolishing.

Further advantageous effects are the uniform polishing effect over a wide operating window. In addition, the electrochemical polishing step used in the present invention is a universal electropolishing process for various copper alloy substrates, which process has smut removing capability. Preferably it is a 2 in 1 process combining the steps of electropolishing and the removal of inclusions (alloying elements). Further, it is useful for deburring.

Suitable compositions for use in the electrochemical polishing step comprise orthophosphoric acid, non-ionic tensides, ethoxylated bis-phenols A, inorganic fluoride salts and polyalcohols.

The compositions comprise orthophosphoric acid in an amount of 500 to 1700 g/185% orthophosphoric acid, more preferred 800 to 1200 g/l.

The non-ionic tensides are contained in an amount of 0.05 to 5 g/l, preferred 0.1 to 1 g/l and include, for example, bis-phenol derivatives, ethoxylated bisphenols A, Luton HF 3 (BASF); polyethyleneoxide, polypropyleneoxide and mixtures thereof, EO/PO blockcopolymers and its derivatives comprising terminal aryl or alkyl groups.

Suitable inorganic fluoride salts for use in the electrochemical polishing composition include, for example, sodium fluoride, potassium fluoride, ammonium hydrogen difluoride and are contained in an amount of 0.1 to 20 g/l, preferred 1 to 5 g/l (calculated as NaF).

Polyalcohols are contained in the composition in an amount of 1 to 100 g/l, preferred 10 to 50 g/l and include glycerol, ethyleneglycol and mannitol.

One preferred composition for use in the electrochemical polishing step according to the present invention is Electro-Glow commercially available from Atotech Deutschland GmbH.

In general, the temperature used in the electropolishing step ranges from 20 to 60° C. with 20 to 30° C. being preferred.

The anodic current density is generally 20 to 50 ASD, preferably 20 to 30 ASD.

The immersion time is in the range of 30 to 90 s.

Agitation during operation is usually not required but preferred.

As the cathode materials stainless steels of 316 type can be used.

The cathode to anode (lead frame) area ratio during operation is preferably >3.

Cleaning of the cathode plate should be done at least weekly and optimum results depend on the loading.

As mentioned above, the first coating applied to the surface of the substrate is a pure nickel coating.

More particularly, the pure nickel coating has a thickness in a range of from about 0.1 μm to about 3 μm. The thickness thereof may be at least about 0.1 μm, typically at least about 0.2 μm, usually at least about 0.3 μm, more preferably at least about 0.4 μm and even more preferably at least about 0.5 μm. The thickness thereof may be equal to or less than about 3 μm and preferably equal to or less than about 1.8 μm.

Depositing the pure nickel coating is achieved by bringing the substrate into contact with a pure nickel electroplating liquid.

Such pure nickel electroplating liquids are well known in the art and for example described in Schlesinger, Paunovic: Modern Electroplating, 4th ed., John Wiley & Sons, Inc., New York, 2000, page 147 and may contain one or more soluble sources of nickel compounds such as nickel halides, e.g., nickel chloride, nickel sulfate, nickel sulfamate, nickel fluoborate and mixtures thereof. Such nickel compounds are typically employed in concentrations sufficient to provide nickel in the electroplating liquid in concentrations ranging from about 10 g/l to about 450 g/l. It is preferred that the nickel-electroplating bath contains nickel sulfate, nickel chloride and nickel sulfamate. It is further preferred that the amount of nickel chloride in the bath is from 8 g/l to 15 g/l and the amount of nickel as nickel sulfamate is from 80 g/l to 450 g/l.

Suitable nickel electroplating liquids typically contain one or more acids, such as boric acid, phosphoric acid or mixtures thereof. Exemplary boric acid containing nickel electroplating baths contain from 30 g/l to 60 g/l of boric acid and preferably about 45 g/l. Typically, the pH of such baths is from about 2.0 to about 5.0, and preferably is about 4.0. The operating temperature of such pure nickel electroplating liquid may range from about 30° C. to about 70° C., and is preferably from 50° C. to 65° C. The average cathode current density may range from about 0.5 to 30 A/dm$^2$ with 3 to 6 A/dm$^2$ providing an optimum range.

A preferred nickel electroplating liquid for use in the present invention is applicant's Ni-Sulphamate HS electroplating liquid which can be used in high speed nickel plating processes designed for continuous plating of strips, wires, connectors and lead frames used in modern reel to reel and spot installations. It provides very ductile, low stress nickel deposits which can be either matte or bright, depending on requirement. If the Ni-Sulphamate HS Additive is used, bright ductile deposits with low porosity and slight tendency to levelling are achievable over a wide current density range.

Depositing the nickel-phosphorus coating is achieved by bringing the substrate coated with the pure nickel coating into contact with a nickel-phosphorus electroplating liquid.

Such nickel-phosphorus electroplating liquids are well known in the art. Such baths may contain the same components as the pure nickel electroplating liquid. These liquids may for example contain nickel sulfamate, nickel sulfate, nickel chloride, amidosulfonic acid, phosphoric acid and boric acid. In addition these liquids contain a phosphorus source such as phosphoric acid, phosphorous acid or derivatives thereof such as a salt, typically a sodium salt thereof.

A preferred nickel-phosphorus electroplating liquid is applicant's Novoplate HS electroplating liquid that is used in a strong acidic process for plating electrolytic NiP-deposits with a phosphorus content of 3 to 25 wt.-%, preferred 4 to 17 wt. %, more preferred 8 to 16 wt.-%. The ammonia free process contains no toxic additives and is not prone to self decomposition. Novoplate HS can be used for barrel, rack and high speed applications. The deposits show excellent corrosion and wear properties.

Conventional electroplating conditions may be used to electrolytically deposit nickel-phosphorus coatings. Typically, the nickel-phosphorus electroplating bath is used at a temperature of 50 to 80° C. Suitable current densities for nickel-phosphorus electroplating are from 1 to 50 A/dm$^2$.

The gold layer can be deposited from known gold electroplating liquids. The process conditions are essentially as follows:

Gold content: 4 to 18 g/l
Temperature: 40 to 65° C.
pH value: 4.0 to 4.8
Current density: 2.5 to 60 A/dm$^2$
Plating speed: 0.5 to 20 μm/min One preferred example for such a plating liquid is applicant's Aurocor HSC/Aurocor HSN plating bath. It is useful in high speed gold plating processes designed for continuous plating of strips, wires, connectors and lead frames used in modern reel to reel and spot installations. The processes produce hard, bright, cobalt or nickel-alloyed deposits, ideal for working electrical contacts which demand ductility as well as resistance to chemical and mechanical attack.

For bond gold applications applicant's commercially available plating baths can be used. The process conditions are essentially as follows: Aurocor K24 HF or Aurochor HS:

Gold content: 1 to 18 g/l
Temperature: 40 to 75° C.
pH value: 3.8 to 7.0
Current density: 0.5 to 60 A/dm$^2$
Plating speed: 0.2 to 15 μm/min To avoid corrosion under heat/humidity storage conditions a post dip can be used. A suitable post dip solution is described in applicant's co-pending European patent application 07013447.3 relating to a solution and a process for increasing the solderability and corrosion resistance of metal or metal alloy surfaces. This solution is an aqueous solution comprising (a) at least one phosphorous compound or its salt represented by the followings formulas

I

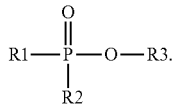

II

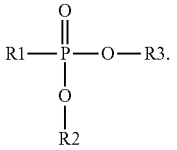

III

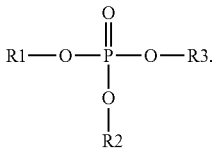

IV

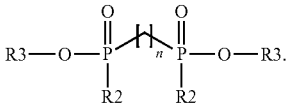

V

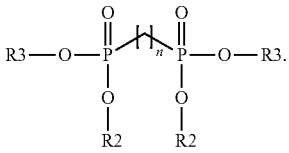

VI

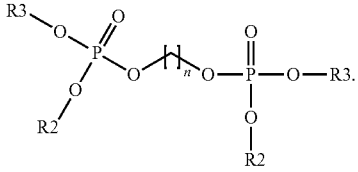

wherein R1, R2 and R3 can be equal or different and are selected independently from the group consisting of H or a suitable counter ion like sodium or potassium $C_1$-$C_{20}$-alkyl, substituted or unsubstituted, linear or branched, $C_1$-$C_6$-alkaryl, linear or branched, substituted or unsubstituted and aryl, substituted or unsubstituted and wherein n is an integral number ranging from 1 to 15.

(b) at least one solderability-enhancing compound or its salt represented by the following formula

VII

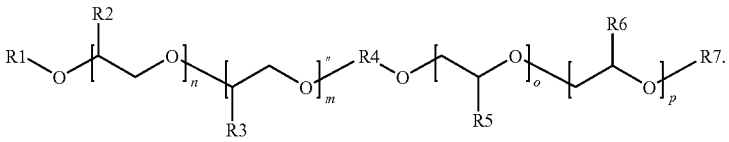

wherein R1 and R7 can be equal or different and are selected independently from the group consisting of H or a suitable counter ion like sodium or potassium, $C_1$-$C_{20}$-alkyl, substituted or unsubstituted, linear or branched, $C_1$-$C_6$-alkaryl, linear or branched, allyl, aryl, sulfate, phosphate, halide and sulfonate and wherein each of the multiple R2, R3, R5 and R6 groups may be the same or different and are selected independently from the group consisting of H or $C_1$-$C_6$-alkyl, linear or branched, substituted or unsubstituted and wherein R4 is selected from the group consisting of $C_1$-$C_{12}$-alkylene, linear or branched, substituted or unsubstituted, aryl 1,2-, 1,3- or 1,4-substituted, naphthyl, 1,3-, 1,4- 1,5- 1,6- or 1,8-substituted, higher annulated aryl, cylcloalkyl and —O—$(CH_2)(CH_2)_nOR1$, wherein R1 has the meaning defined above and R4 is selected from the group represented by the following formula

VIII

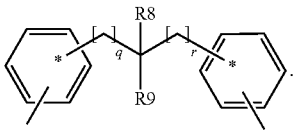

wherein the substitution independently is 1,2-, 1,3- or 1,4 for each ring and wherein q and r are equal or different and 0 to 10 and R8 and R9 are selected independently from the group consisting of H or $C_1$-$C_6$-alkyl, linear or branched and wherein m, n, o and p are integral numbers ranging from 0 to 200 and can be equal or different and m+n+o+p is at least 2.

Preferred aqueous post dip solutions are described on page 7, line 1 to page 8, line 7 of this application, which solutions are also preferred solutions for use in the present invention.

The aqueous compositions used in the present invention usually have a pH of 1-8, preferably of 2-5. In order to ensure a constant pH value during operation preferably a buffer system is applied to the solution. Suitable buffer systems comprise formic acid/formiate, tartaric acid/tartrate, citric acid/citrate, acetic acid/acetate and oxalic acid/oxalate. Preferably, the sodium or potassium salt of the aforementioned acid salts are used. Besides the mentioned acids and corresponding salts, all buffer systems can be applied which result in a pH value of the aqueous compositions of 1-8, preferably of 2-5.

The buffer concentration is in the range of 5-200 g/l for the acid and of 1-200 g/l for its corresponding salt.

The at least one phosphor compound a) represented by the formulas I. to VI. of the aqueous solutions is preferably used in an amount of 0.0001 to 0.05 mol/l, more preferably 0.001 to 0.01 mol/l.

The at least one solderability-enhancing compound (b) represented by the formula VII. is generally used in an amount of 0.0001 to 0.1 mol/l, preferably 0.001 to 0.005 mol/l.

Optionally, the solution may additionally contain an anti-foaming agent which is commercially available.

One preferred post dip solution is applicant's Protectostan solution which is a highly efficient anti-corrosion agent.

The layer system according to the present invention can be successfully used in electronic device substrates, more particularly lead lines of electronic components, more specifically lead lines of lead frames or of electrical connectors or of electrical contacts or of passive components, such as chip capacitors and chip resistors.

The invention is further illustrated by the following examples.

PREPARATION EXAMPLES

The coatings described in Examples 3-6 were prepared with a process sequence as shown in Table 1. For Examples 1-2, process step 3 was omitted.

Before plating, the substrates were degreased (ultra-sonic degreasing; cathodic degreasing) and before the electropolishing step, the substrates were activated with applicant's Uniclean 675. Following the plating of the Ni layer, the surface was activated using 10% sulfuric acid. After Ni—P plating, the surface was again activated with 10% sulfuric acid and then the Au layer was plated. Between every step the samples were rinsed with city water.

The substrates were finally dried and subjected to the corrosion resistance test described hereinafter.

TABLE 1

Process sequence used for examples 1-6.

| Step | Temperature | Components |
|---|---|---|
| 1 | 30° C. | Electroglow (Electropolishing) |
| 2 | 55° C. | Nickelsulphamate HS (Ni) |
| 3 | 70° C. | Novoplate HS (Ni—P) |
| 4 | 30° C. | Aurochor HSC (pre-Au) |
| 5 | Room temperature to 60° C. | Auchrochor HSC (AU) |
| 6 | Room temperature | Postdip |

As a substrate the base material CuSn6, sample size 0.3×25×100 mm was selected.

The following layer combinations Ni/Ni—P/Au were prepared and the conditions as well as the layer thicknesses, the phosphor contents and additional elements are specified below:

1) Electropolishing (ElectroGlow):
Make-up: see TDS (750 ml/l ElectroGlow A+60 ml/l ElectroGlow B)
Temperature: 25° C.
Current density: 60 A/dm$^2$
Exposition time: 5 s
2) Ni-electrolyte (Ni-Sulphamate HS)
Make-up: 100 to 110 g/l Ni, 4 to 8 g/l chloride, no additive
Temperature: 55° C.
Current density: 10 A/dm$^2$
pH: 3.5 to 4
thickness: 1.2 to 1.4 μm (sum of N and NiP=1.5 μm)
3) NiP-electrolyte (Novoplate HS)
Make-up: 100 to 120 g/l Ni, 100 ml/l Novoplate HS Replenisher
Temperature: 70° C.
Current density: 10 A/dm$^2$
pH: 1.2 to 1.8
thickness: 0.1 to 0.3 μm (sum of Ni and NiP=1.5 μm)
P-content of the deposit: 12 to 15 wt.-% P
4) Au-electrolyte (Aurocor SC, Co-alloyed)
Make-up: 4 g/l Au
Temperature: 41 to 43° C.
Current density: 11 A/dm$^2$
pH: 4 to 4.2
thickness: 0.3 μm
Corrosion Resistance Test (NAV Test)

The standard test for porosity in Au coatings on metal substrates employing nitric acid vapour (NAV) at low relative humidity (ASTM B 735-95) was used. In this test the reaction of the gas mixture with a corrodible base metal at pore sites produces reaction products that appear as discreet spots on the Au surface. This test method is intended to be used for quantitative description of porosity (i.e., the number of pores per unit area).

The test parameters used were as follows:

(i) $HNO_3$: 70%

(ii) exposure time: 120 min (ASTM Standard 60 min)

(iii) relative humidity: 55%

(iv) temperature: 23° C.

The layer systems obtained in Examples 1 to 6 above were subjected to the corrosion resistance test described above.

The results are listed in Tables 2a and 2b below:

TABLE 2a

| Example | Electro-polishing | Thickness of Ni layer | Thickness of Ni—P layer | Thickness of Ni + Ni—P layer | Thickness of Au—Co layer |
|---|---|---|---|---|---|
| 1 | no | 1.5 μm | — | 1.5 μm | 0.3 μm |
| 2 | yes | 1.5 μm | — | 1.5 μm | 0.3 μm |
| 3 | no | 1.4 μm | 0.1 μm | 1.5 μm | 0.3 μm |
| 4 | yes | 1.4 μm | 0.1 μm | 1.5 μm | 0.3 μm |
| 5 | no | 1.2 μm | 0.3 μm | 1.5 μm | 0.3 μm |
| 6 | yes | 1.2 μm | 0.3 μm | 1.5 μm | 0.3 μm |

TABLE 2b

| Example | No. of pores with size <0.05 mm | No. of pores with size 0.05-0.12 mm | No. of pores with size 0.12 < x < 0.4 mm | No. of pores with pore size >0.4 mm | Total No. of pores |
|---|---|---|---|---|---|
| 1 | 3.3 | 5.3 | 5.7 | 0.0 | 14.3 |
| 2 | 1.7 | 2.0 | 2.3 | 0.0 | 6.0 |
| 3 | 7.0 | 8.3 | 7.7 | 0.0 | 23.0 |
| 4 | 1.3 | 0.3 | 1.7 | 0.3 | 3.6 |
| 5 | 14.0 | 8.0 | 5.0 | 0.0 | 27.0 |
| 6 | 2.3 | 0.3 | 2.7 | 0.0 | 5.3 |

The total number of pores measured for Examples 1 to 6 is shown in FIG. 1.

From these results, the following conclusions can be drawn:

For layer systems coated onto substrates which are not electropolished prior to metal layer deposition, the best NAV test performance in terms of "sum of pores" is reached for a two layer system consisting of Ni and Au (Example 1) compared to three layer systems comprising Ni, Ni—P and Au (Examples 3 and 5). A layer system according to Example 1, however, is relatively brittle and cracks may form, especially in flexible substrates. Thus the physical, in particular mechanical, properties are impaired especially at high temperature. Such cracks may form particularly in connectors and lead frames.

The corrosion resistance is strongly enhanced, if the substrate is subjected to an electropolishing procedure prior to metal layer deposition. Surprisingly, the electropolishing of substrates has a stronger positive influence on the layer systems consisting of Ni, Ni—P and Au (Examples 4 and 6) compared to the two layer system comprising Ni and Au (Example 2). In addition, the inventive Examples 4 and 6 have superior mechanical properties, like superior fatigue resistance, ductility and tensile strength. Such superior mechanical characteristics may particularly be required if a lead frame or connector is considered to ensure sufficient bending performance.

The invention claimed is:

1. A process for the preparation of a layer system comprising on a substrate (i) a Ni layer having a thickness ≦3.0 μm, (ii) a Ni—P layer having a thickness ≦1.0 μm, (iii) a Au layer ≦1.0 μm comprising the following steps:

(i) electropolishing the surface of said substrate, (ii) plating a Ni layer onto the electropolished surface obtained in step (i) above such that the thickness of said Ni layer is ≦3.0 μm, (iii) plating a Ni—P layer onto the Ni layer obtained in step (ii) above such that the thickness of said Ni—P layer is ≦1.0 μm, (iv) plating an Au layer onto the Ni—P layer obtained in step (iii) above such that the thickness of said Au layer is ≦1.0 μm.

2. The process according to claim 1, further comprising the steps of (v) hot degreasing, (vi) cathodic degreasing and (vii) acid rinsing prior to the electropolishing step (i).

3. The process according to claim 1 wherein the Ni layer is plated with a thickness of 1.0 to 2.0 μm onto the electropolished surface.

4. The process according to claim 1, further comprising (viii) the step of treating the layer system with a post dip after step (iv).

5. An electronic device substrate comprising the layer system obtained by the process according to claim 1.

6. The electronic device substrate according to claim 5 which is a lead line of an electronic component.

7. The electronic device substrate according to claim 6 which is a lead line of a lead frame, an electrical connector, an electrical contact or a passive component.

8. The electronic device substrate according to claim 7 wherein the passive component is a chip capacitor or a chip resistor.

9. The process according to claim 1 wherein the substrate comprises a copper-based substrate.

10. The process according to claim 1 wherein the Ni—P layer has a thickness in the range of 0.05 μm to 0.80 μm.

11. The process according to claim 10 wherein the Ni—P layer has a thickness in the range of 0.1 μm to 0.40 μm.

12. A process according to claim 1 wherein the Ni layer has a thickness of 1.0 to 2.0 μm.

13. The process according to claim 1 wherein the layer system has been treated with a post dip.

14. The process according to claim 1 wherein the Ni—P layer (i) has a phosphorous content of 3 to 25 wt.-%.

15. The process according to claim 1 wherein the Au layer further comprises an element selected from the group consisting of Fe, Co and Ni.

* * * * *